US007887136B2

(12) United States Patent
Zoell

(10) Patent No.: US 7,887,136 B2
(45) Date of Patent: Feb. 15, 2011

(54) DEVICE FOR SUPPORTING A HUMAN BODY IN VARIOUS POSITIONS

(76) Inventor: Stefan Zoell, Connollystrasse 3/E01, Muenchen (DE) 80809

( * ) Notice: Subject to any disclaimer, the term of this patent is extended or adjusted under 35 U.S.C. 154(b) by 209 days.

(21) Appl. No.: 12/228,721

(22) Filed: Aug. 15, 2008

(65) Prior Publication Data

US 2009/0058151 A1 Mar. 5, 2009

(30) Foreign Application Priority Data

Aug. 16, 2007 (DE) ..... 10 2007 038 829

(51) Int. Cl.

| | |
|---|---|
| ***A47C 1/00*** | (2006.01) |
| ***A47C 3/00*** | (2006.01) |
| ***A47C 7/14*** | (2006.01) |
| ***A47C 7/50*** | (2006.01) |
| ***A47C 9/00*** | (2006.01) |

(52) U.S. Cl. ..... 297/423.12; 297/423.11; 297/423.13; 297/4; 297/284.3; 297/338

(58) Field of Classification Search ..... 297/423.11, 297/423.12, 423.13, 338, 4, 284.3
See application file for complete search history.

(56) References Cited

U.S. PATENT DOCUMENTS

| | | | | | |
|---|---|---|---|---|---|
| 1,065,022 | A | * | 6/1913 | Bell | 297/423.12 X |
| 1,217,246 | A | | 2/1917 | Wallace | |
| 3,477,673 | A | * | 11/1969 | Bereday | 297/423.1 X |
| 3,663,055 | A | | 5/1972 | Gale | |
| 3,754,787 | A | * | 8/1973 | Garber | 297/423.38 X |
| 4,138,156 | A | * | 2/1979 | Bonner | 297/4 |
| 4,589,699 | A | * | 5/1986 | Dungan | 297/423.12 |
| 4,603,444 | A | | 8/1986 | Suits | |
| 4,765,684 | A | * | 8/1988 | Kvalheim et al. | 297/423.13 |
| 4,793,655 | A | * | 12/1988 | Kvalheim et al. | 297/423.13 |
| 4,832,407 | A | * | 5/1989 | Serber | 297/423.12 |
| 5,149,174 | A | * | 9/1992 | Charash | 297/423.12 |
| 5,199,763 | A | * | 4/1993 | Wilder et al. | 297/338 |
| 5,255,957 | A | * | 10/1993 | Opsvik et al. | 297/423.12 |
| 5,295,728 | A | * | 3/1994 | Schaevitz | 297/423.12 X |
| 5,401,078 | A | * | 3/1995 | Riach | 297/423.11 |
| 5,542,746 | A | * | 8/1996 | Bujaryn | 297/423.12 |
| 5,667,278 | A | * | 9/1997 | Li | 297/423.13 |

(Continued)

FOREIGN PATENT DOCUMENTS

| | | |
|---|---|---|
| DE | 1149147 | 5/1963 |

(Continued)

*Primary Examiner*—Rodney B White
(74) *Attorney, Agent, or Firm*—Simpson & Simpson, PLLC

(57) ABSTRACT

A device (1) for supporting a human body comprising at least one support element (10) defining a cross-sectional area (50) and at least one longitudinal bar (13), whereby the support element (10) is positionable in height and depth. A support bar (11) for each of the at least one support elements (10) is directly connected to the at least one longitudinal bar (13). The support bar (11) extends at least partly along a first longitudinal axis (12) of the at least one support element (10) through the at least one support element (10). The support bar (11) is eccentrically arranged in the cross-sectional area (50) of the at least one support element (10). The invention furthermore discloses an application of the device (1) for supporting a human body in a working system (35).

17 Claims, 17 Drawing Sheets

U.S. PATENT DOCUMENTS

| | | | | |
|---|---|---|---|---|
| 5,971,485 | A * | 10/1999 | Clark | 297/423.12 |
| 6,698,831 | B2 * | 3/2004 | Lloyd | 297/423.11 X |
| 6,959,962 | B2 * | 11/2005 | Dixon | 297/195.11 |
| 7,093,900 | B1 * | 8/2006 | Schon | 297/423.25 X |
| 7,144,080 | B2 * | 12/2006 | Lloyd | 297/423.12 X |
| 7,261,368 | B1 * | 8/2007 | Clausnitzer | 297/423.12 X |
| 7,273,252 | B2 * | 9/2007 | Iijima et al. | 297/284.3 |
| 7,367,623 | B2 * | 5/2008 | Tholkes et al. | 297/423.11 X |
| 2002/0067060 | A1 * | 6/2002 | Lloyd | 297/423.11 X |
| 2005/0035644 | A1 * | 2/2005 | Lloyd | 297/423.11 |
| 2006/0255635 | A1 * | 11/2006 | Iijima et al. | 297/284.3 |
| 2007/0007400 | A1 | 1/2007 | James | |
| 2007/0052275 | A1 * | 3/2007 | Ghilzai | 297/423.12 |
| 2007/0085405 | A1 * | 4/2007 | Grotner | 297/423.11 |
| 2008/0143164 | A1 * | 6/2008 | Ghilzai | 297/423.12 |
| 2009/0167072 | A1 * | 7/2009 | Cochran | 297/423.12 |

FOREIGN PATENT DOCUMENTS

| | | | | |
|---|---|---|---|---|
| DE | 7531129 | | 3/1976 | |
| DE | 8001181 | | 6/1980 | |
| DE | 3308336 | | 9/1984 | |
| DE | 3630634 | A1 * | 3/1988 | 297/423.12 |
| DE | 4118013 | | 12/1992 | |
| DE | 9303518 | | 8/1993 | |
| DE | 29516939 | | 2/1996 | |
| DE | 29721944 | | 5/1998 | |
| DE | 19850438 | | 5/2000 | |
| DE | 19910615 | | 6/2000 | |
| EP | 252274 | A2 * | 1/1988 | 297/423.13 |
| EP | 0531208 | | 3/1993 | |
| FR | 2552987 | A1 * | 4/1985 | 297/423.12 |
| FR | 2569964 | | 3/1986 | |
| GB | 2442873 | | 4/2008 | |
| JP | 08131295 | | 5/1998 | |
| JP | 11155692 | | 6/1999 | |
| WO | WO 8804903 | A1 * | 7/1988 | 297/423.13 |

* cited by examiner

DEVICE FOR SUPPORTING A HUMAN BODY IN VARIOUS POSITIONS

CROSS REFERENCE TO RELATED APPLICATION

This patent application claims priority of German Patent Application No. 10 2007 038 829.4, filed on Aug. 16, 2007, which application is incorporated herein by reference.

FIELD OF THE INVENTION

The present invention relates to a device for supporting a human body. In particular, the present invention relates to a device for supporting a human body with at least one support element and at least one longitudinal bar, whereby each of the at least one support element is connected to one or two longitudinal bars and the at least one support element is positionable in height and depth.

Furthermore, the present invention relates to a working system in a production line comprising of at least one device for supporting a human body.

BACKGROUND OF THE INVENTION

Variable devices for supported sitting or standing positions with positioning elements which can be adjusted to accommodate different human body sizes and weight, or to accommodate different sitting and standing positions respectively, as well as to support different body parts, for instance to support stand-sit positions, are known. A standing seat for a public transportation vehicle is disclosed in German Patent DE 198 50 438 C2. The standing seat comprises a support element with a mechanism for height positioning. The support element is laterally arranged above an axis to a pillar which is fixed to the vehicle floor. This standing seat is not positionable in depth. It is not suitable for the use in a multifunctional working system.

Furniture for sitting in the residential domain with preferably upholstered support elements is disclosed in German Utility Model DE 80 01 181, whereby the support elements are attached to bars which are arranged to each other with a fixed angle to form an about isosceles triangle. This furniture for sitting does not show positionable support elements. The furniture only offers support for the fundament and the back of a user.

A seat for working in a standing position with a horseshoe shaped foot element is disclosed in European Patent EP 0 531 208 B1. The horseshoe shaped foot element is open towards the front relative to the seat. This standing seat is in fact positionable in height and depth, but offers only a support for the fundament of a user. The feet of the user touch the ground while using the standing seat. It is also not suitable for use in a multifunctional working system, especially not in a production line.

An ergonomic seat is disclosed in German Utility Model DE 297 21 944 U1, whereby the body's center of gravity is lowered only insignificantly. The seat includes support elements, but there are no bars connected to the support elements and also no floor element, so that this seat is neither positionable in height nor in depth, though it offers some options for the use by people with different sizes. The seat does not offer any support for the knees or the head. It is also not suitable for the use in a multifunctional working system, especially not in a production line.

A workplace seat with a saddle-seat, a longitudinal bar, a floor element and a ball-and-socket joint is disclosed in German Utility Model DE 75 31 129. The workplace seat is positionable in height and depth by means of the ball-and-socket joint. However, it merely offers support for the fundament of a user and is thus only partly suitable for a working system, by no means, however, in a multifunctional working system as, for example, in a production line. A reclining support against which a worker's fundament can be leaned while the worker is in a standing position is disclosed in published German Patent Application DE 1 149 147. This reclining support is positionable in height, but not positionable in depth, and it only offers a support for the fundament. In addition, it does not allow the support of a human body in a plurality of positions.

A lumbar support with support elements fixedly positioned relative to each other is disclosed in French Patent Specification FR 2 569 964. The position of the lumbar support can be altered within a relatively small range along two bars to which the support elements are mounted. This lumbar support is thus positionable in height and depth to a limited degree; however, it only offers support for the fundament of a user. It is suitable as a lumbar support and as a support in seating or standing position in public transport.

One disadvantage of the described devices is that they offer no comprehensively integrated solution for the support of diverse different body parts, and that they therefore offer no workplace seat, no knee seat, no support in a standing position, no supported-standing seat and no foot support.

A further disadvantage is that the devices are positionable in height and depth only to a limited extent, if at all, so that they neither satisfy the present ergonomic requirements for a plurality of body positions nor are they suited for the use in a multifunctional work system or a production line.

SUMMARY OF THE INVENTION

It is therefore an object of the present invention to provide a device for supporting a human body which is variably positionable to fit a plurality of anatomic and ergonomic requirements.

The above object is solved by a device for supporting a human body, which comprises features and elements of the appended claims.

Advantageous embodiments of the invention are defined in the dependent claims and the following description.

It is a further object of the invention to provide a device for supporting a human body which is used in a working system.

This objective is solved by a working system in a production line which comprises features and elements of the appended claims.

The device for supporting a human body according to the present invention comprises at least one support element and at least one longitudinal bar. The support elements are usually arranged horizontally lengthwise, so that for instance any part of the human body of a user, such as feet, lower legs, knees, thighs, fundament, abdomen, chest, lower back (lumbar), middle back, upper back (nape of the neck), neck and/or head, can rest on or lean against the respective support element. For the simultaneous support of several parts of a human body more support elements are required accordingly.

Each of the support elements is connected to one or two of the longitudinal bars. The support element located furthest from a floor on which the device for supporting a human body stands is connected to a downwards running longitudinal bar. Above this particular support element no further longitudinal bar is required. The support element located opposite to the floor on which the device for supporting a human body stands is connected to at least one longitudinal bar. The other support elements are usually connected to two longitudinal bars, of which one longitudinal bar points downwards with regard to the respective support element and the other longitudinal bar points upwards with regard to the respective support element. In case two support elements are to be positioned relatively far apart from each other, at least an additional longitudinal bar can be arranged between and connected to the two longitudinal bars already carrying the support elements.

According to the described embodiments, all of the longitudinal bars run along one single side or end of the support elements, so that the opposite ends of the support elements are free and unsupported ends not connected to any other elements of the device. This embodiment, described below, is not to be considered as a limitation the invention. Advantages of the single side-free and unsupported support elements are an improved ability to rotate the support elements around their own respective first longitudinal axis and around the longitudinal bars, as well as small material consumption. Another advantage is the ergonomically optimal use with regard to the accessibility, for example if the device for supporting a human body is used as knee seat.

The support elements are positionable in height and depth so that the device according to the invention enables changes between various different body positions, multifunctional positioning options, as well as settings for inter-individual body differences, such as body size and weight.

A single support element comprises a support bar which is eccentrically arranged with respect to the cross-sectional area of the support element and this support bar connects the support element directly to one of the longitudinal bars. The support bar thereby extends at least partly along the first longitudinal axis of the support element through the support element. This enables an eccentric rotation around the first longitudinal axis of the support element. In addition to the previously mentioned positioning options, this characteristic offers further options, especially if each of the at least one support elements is cushioned for body support. Even if several or all of the cushion's lateral surface areas are equally shaped, the position of such a surface area can vary by eccentrically rotating the respective support element around its support bar, and it can thus be positioned according to the requirements of the user.

Over and above that, the cushion's lateral surface areas can also be shaped differently. For example, the shape of one lateral surface area may be a flat surface, which for instance is suitable as a footrest or as a fundament support. The shape of another lateral surface area of the same cushion may be concave, so that this surface area is suited to rest the knees, also the fundament, the lumbar, etc. The shape of a third lateral surface area may be convex for example, so that this surface area is suited to rest the head. For economical reasons, all cushions are usually of the same shape, so that they are suited to support any of the mentioned body parts.

It may be of additional advantage that a foot support is removable and attachable to at least one lateral surface area of the cushion of the support element which is located opposite to the floor on which the device for supporting a human body stands. The foot support, for example a step board with brackets to be fixed onto the cushion, protects the cushion from soiling and abrasions. The foot support should be mountable to each of the lateral surface areas, which is ensured if the lateral surface areas are shaped equally, and, depending on body or leg length of the respective user, a desired position for the foot support can be adjusted by selecting a matching lateral surface area through eccentric rotation of the cushion around its support bar of the support element located opposite to the floor on which the device for supporting a human body stands.

The device for supporting a human body according to the invention may comprise a floor element to support the device on its foundation or floor. However, further embodiments are conceivable, where the device is instead, or additionally, mounted to a ceiling or to walls.

For user friendly options, the floor element may be rotatable, preferably in a continuous adjustable manner. The floor element should be centrically rotatable, to ensure that during and before or after a rotation the part of the floor element which moves during the rotation overlaps with the lower part of the floor element which is located opposite to the floor on which the device for supporting a human body stands and which is stationary during the rotation. The floor element should be securable by using stop elements which are well known in the prior art, so that it is immobile in a fixedly secured position, to ensure that a user can work from the device without undesired alterations of the position of the device.

For miscellaneous use, the floor element of the device for supporting a human body may comprise an element for floor guidance, for example a roller ring of an office or work chair according to the prior art. Alternatively, or in addition, the floor guidance element may interact with a translation element located on the floor. The translation element may, for example, be familiar guide rails, and the floor guidance element may be wheels or castors according to the prior art which are navigable (mobile, wheeled, passable) on those guide rails. Such an embodiment is suitable for production line work. Typically, the translation of the floor element should be positionable, preferably in a continuous adjustable manner.

The floor element may comprise an anti-slipping element, for instance of rubber.

With respect to the construction of the device, the longitudinal bar opposite to the floor on which the device for supporting a human body stands is connected to the floor element, and all longitudinal bars are longitudinally arranged in series, so that all of the support elements are connected to the longitudinal bars with one of their ends of the support elements. If an embodiment comprises more than one longitudinal bar, different ends of the support elements may be mounted to the respective longitudinal bars, for example, the longitudinal bars can be alternately connected to the right or the left end of the support elements. The support elements are usually positionable in height as well as in depth through altering the position of the longitudinal bars, preferably in a continuous manner. In addition, each of the support elements is positionable in height and depth independently of the other support elements, by means of an eccentric rotation of the support element around its respective support bar.

The angle between two successive longitudinal bars is usually positioned by means of a joint, whereby the joint connects the two successive longitudinal bars. The angle between the floor element and the respective longitudinal bar is positioned accordingly, whereby the joint connects the floor element with the respective longitudinal bar.

For skewed user positions, for example, where the user has to lean forward to the right or left, it may be advantageous if at least one of the support elements is rotatable around a second longitudinal axis defined by the longitudinal bar to which the respective support element is connected.

It may be of additional advantage to use longitudinal bars of different length, for example shorter longitudinal bars for the head and longer longitudinal bars for the trunk.

Positioning elements, known from prior art, may be arranged at various positions of the device in order to effect the desired position of the device. Thus the angle between two successive longitudinal bars can be positioned by means of the positioning elements at the joints. The angle between the floor element and its respective longitudinal bar may be positioned accordingly by means of a positioning element at the joint of this longitudinal bar. Positioning elements at the ends of the support elements may adjust the eccentric rotation of the support elements around their respective support bars. Furthermore, the rotation of the floor element may be adjustable by means of a positioning element at the floor element. The positioning elements may be operated manually or automatically.

The multitude of positioning elements may turn manual positioning into a laborious process. Centrally controlled positioning is therefore desirable, whereby each of the support elements, each of longitudinal bars and the floor element are positionable individually but centrally by a positioning module. The device according to the invention may comprise an mechanical/electronic positioning module with which the body proportions and the weight of the user are determined and stored by means of Radio Frequency Identification technology or other identification technologies known from the prior art. The actual position of the device is sensed and actuators are used to place the device into the requested position. Such a mechanical/electronic positioning module may in addition comprise a transponder, which reads and stores the body proportions and the weight of the user as well as the individually ideal and requested positions of the support elements from an electronic chip.

All parts of the device can be manufactured of any standard components, or rather are standard components; in other words, standardized assembly parts which are not subject to any national or international norms.

The device for supporting a human body according to the invention can be used in a working system, especially a working system in a production line. Apart from the use in industrial working systems and office domains, it is also conceivable to use the device in wellness and/or home domains and other private and business domains where a support of the human body in different positions may be required.

BRIEF DESCRIPTION OF THE DRAWINGS

There are numerous ways of advantageously developing and improving the teachings of the present invention. Here, reference is made on the one hand to the claims and on the other hand to the subsequent explanation of a preferred exemplary embodiment of the invention with reference to the drawings. In conjunction with the description of the preferred exemplary embodiment of the invention with reference to the drawings, generally preferred embodiments and improvements to the teachings will also be explained.

In the drawings.

DETAILED DESCRIPTION OF THE INVENTION

Figure 1:
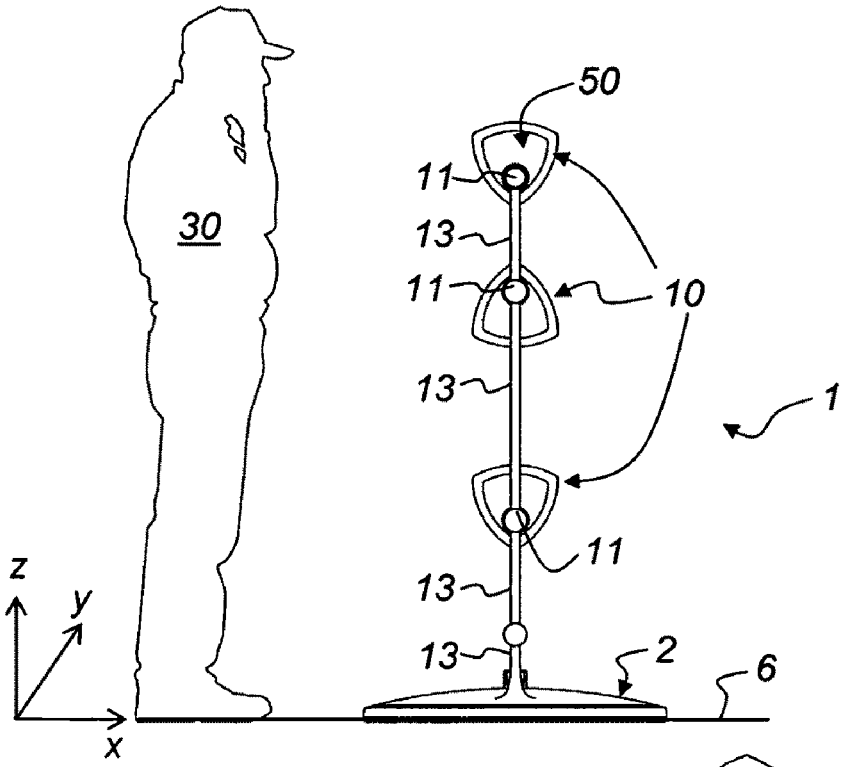
FIG. 1 shows a schematic side view of an embodiment of the inventive device for supporting a human body with three support elements.

FIG. 1 shows a schematic side view of an embodiment of a device 1 for supporting a human body wherein device 1 has three support elements 10 and a floor element 2 on a floor 6 in an initial position, whereby longitudinal bars 13 are arranged vertically with respect to support elements 10. A user 30 is depicted in order to illustrate the potential proportions with respect to device 1. Support elements 10 are shown in cross-section, whereby the lower and upper elements 10 are rotated differently around their respective support bar 11 in comparison with the middle support element 10. Support bars 11 are eccentrically arranged in a cross-sectional area 50 of their respective support element 10 in all three cases (see FIG. 17). The three support elements 10 differ in their positions due to different rotations, even though they are shaped the same, which is also explained in the figures further on. Lower and upper support elements 10 point upwards and middle support element 10 points downwards.

In this embodiment, the lower and upper longitudinal bars 13 are shorter than the middle longitudinal bar 13.

Floor element 2 in this and following embodiments is of circular shape; however, other morphologies are possible, for example, a rectangle, a polygon, an eclipse, etc. The following descriptions refer to circular floor elements 2 only, which, however, should not be understood as a limitation of the invention.

A three-dimensional coordinate system is shown. The depth of the respective support element 10 and longitudinal bar 13 can be adjusted along the x-axis by means of the above described elements. The height of the respective support element 10 and longitudinal bar 13 can be adjusted along the z-axis by means of the above described elements. Floor element 2 is rotatable within an x/y-plane. Consequently, depending on the rotation of floor element 2, device 1 is positionable in x- and y-directions and support elements 10 and longitudinal bars 13 are positionable in x-, y- and z-directions.

Figure 2:
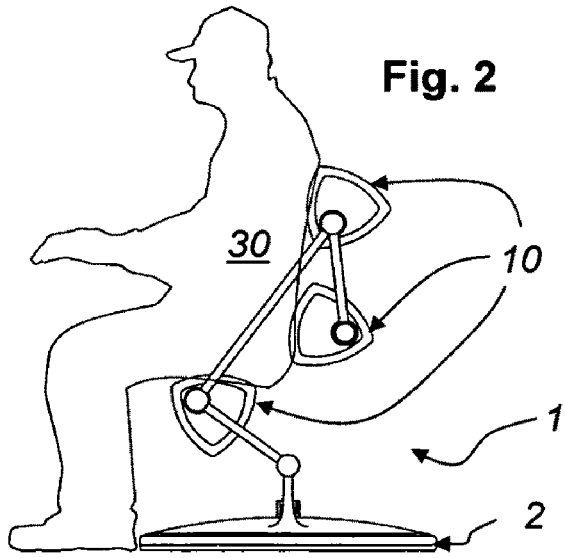
FIG. 2 shows a schematic side view of the device for supporting a human body according to FIG. 1 used as a workplace seat.

FIG. 2 shows a schematic side view of device 1 for supporting a human body used as a workplace seat. The angles between the respective longitudinal bars 13 are positioned in such a way that user 30 can sit on support element 10 which is opposite to the floor on which device 1 stands, while being supported in both the upper back and the lumbar region by the other two support elements 10. Support element 10 which was furthest from the floor on which device 1 stands according to the initial position in FIG. 1 has now, in FIG. 2, become support element 10 which is located in the middle of device 1 by positioning longitudinal bars 13 accordingly. In addition, support elements 10 are eccentrically rotated around their respective support bars 11 in such a way that matching lateral surface areas of support elements 10 are arranged according to the required position of the support.

Figure 3:
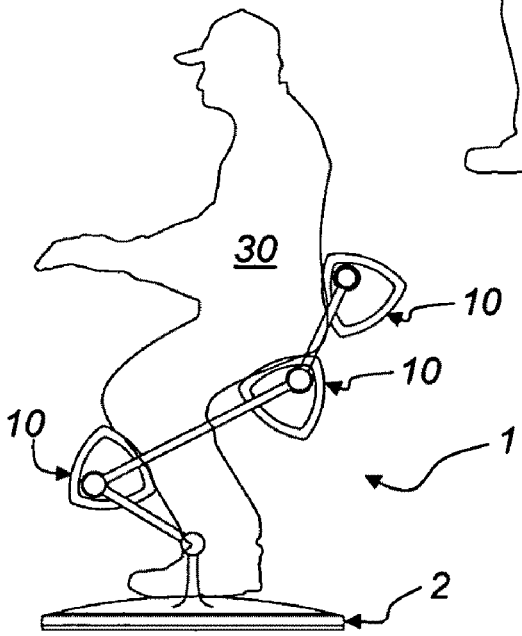
FIG. 3 shows a schematic side view of the device for supporting a human body according to FIG. 1 used as a knee seat.

FIG. 3 shows a schematic side view of device 1 for supporting a human body according to FIG. 1 used as a knee seat. Here, the angles between longitudinal bars 13 are of different size as compared to FIG. 2, namely in such a way that user 30 can sit on support element 10 which is located in the middle of device 1 while the lumbar region is supported by support element 10 which is furthest from the floor on which device 1 is standing, and the knees are supported by support element 10 which is opposite the floor on which device 1 is standing. Once again, support elements 10 are eccentrically rotated around their respective support bars 11 in such a way that matching lateral surface areas of support elements 10 are arranged according to the required position of the support.

Figure 4:
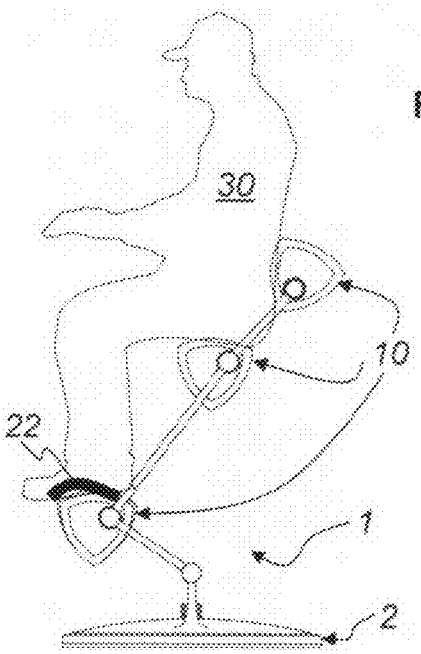
FIG. 4 shows a schematic side view of the device for supporting a human body according to FIG. 1 used as a standing seat.

FIG. 4 shows a schematic side view of device 1 for supporting a human body according to FIG. 1 used as a standing seat. The angles between longitudinal bars 13 are sized in such a way that user 30 can sit on middle support element 10, while the lumbar region is supported by upper support element 10, and the feet are supported by support element 10 arranged on the lowest support element 10. Support elements 10 are once again eccentrically rotated around their respective support bars 11 to ensure a necessary, matching lateral surface area lateral surface area for support.

Figure 5:
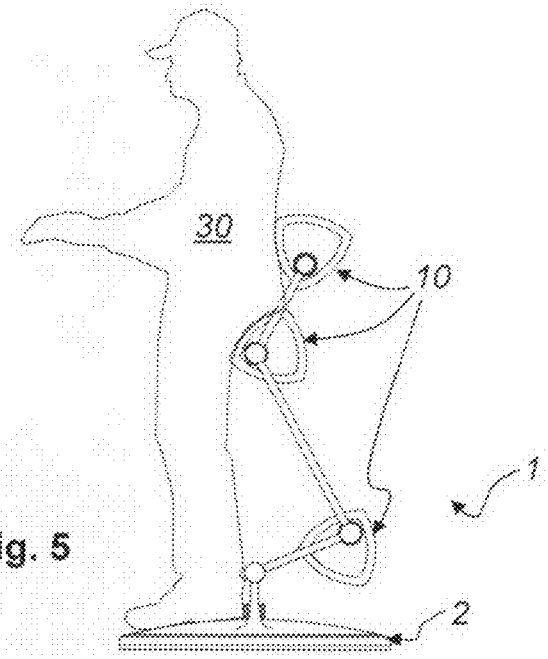
FIG. 5 shows a schematic side view of the device for supporting a human body according to FIG. 1 used as a support in a standing position.

FIG. 5 shows a schematic side view of device 1 for supporting a human body according to FIG. 1 used as a support in a standing position, wherein the setting of the angles between longitudinal bars 13 is in such a way that user's 30 lumbar region leans against upper support element 10 and user's 30 fundament leans against middle support element 10. The feet rest on floor element 2. Lower support element 10 is not required in this type of positioning of device 1, and it does not support any body part. Upper and middle support elements 10 are again eccentrically rotated around their respective support bars 11 to ensure a matching lateral surface area of the respective support element 10 for support.

Figure 6:
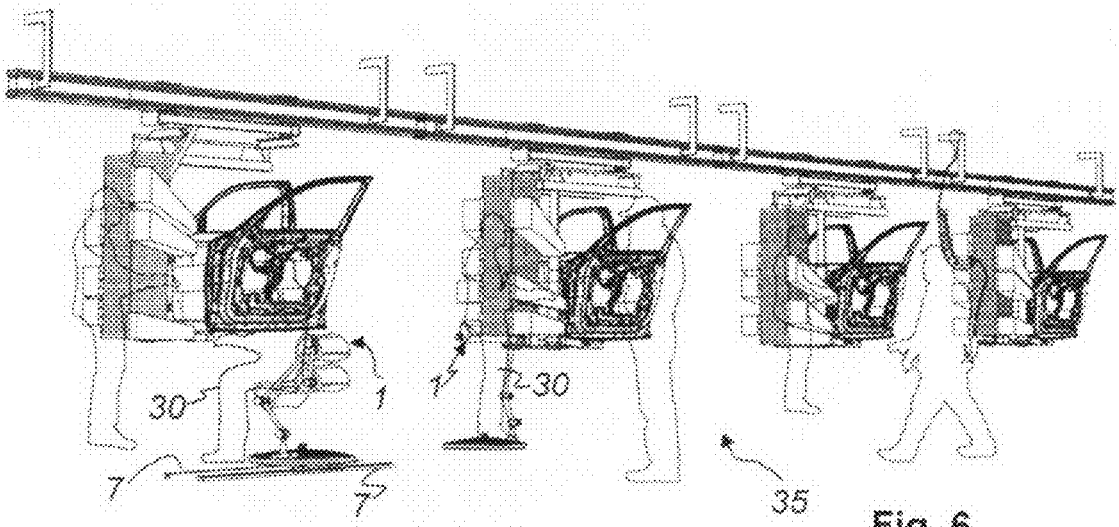
FIG. 6 shows a schematic side view of the device for supporting a human body according to FIG. 1 used in a working system.

FIG. 6 shows a schematic side view of device 1 for supporting a human body according to FIG. 1 used in a working system 35; here specifically, in a motor vehicle door production line. Still today, many jobs in commercial industry are carried out in the standing position. Many production line jobs exist, especially in the automobile industry, where assembling is predominantly carried out in a standing position on grounds of the geometry of the components or how the components are conveyed. A change of the body position from standing to sitting reduces the body strain. Guide rails 7 for the translation of device 1 are indicated. Device 1 can be wheeled on guide rails 7 by means of an element for floor guidance (not illustrated) which are attached to floor element 2.

Figure 7:
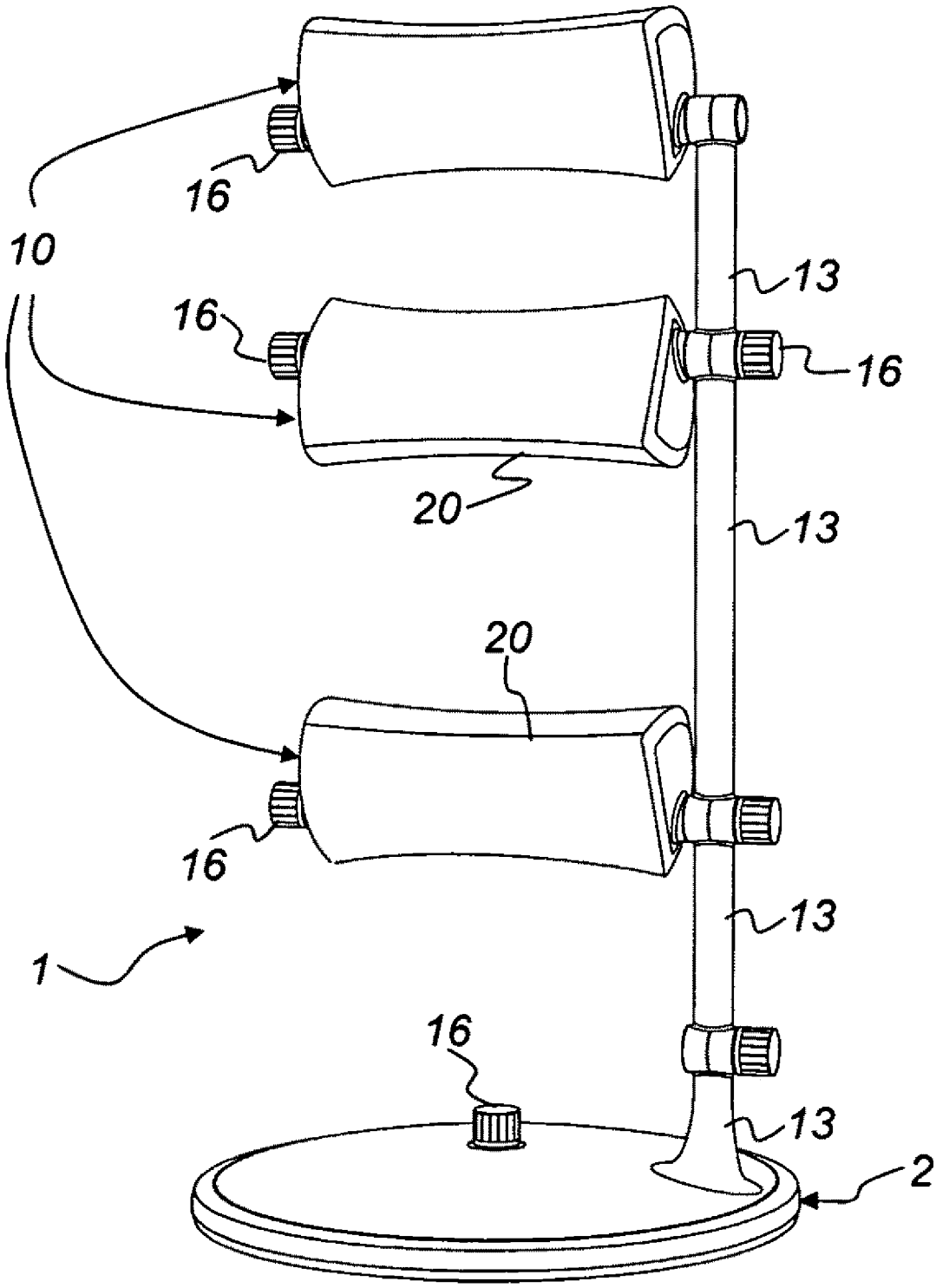
FIG. 7 shows a perspective view of the device for supporting a human body, wherein the device has three support elements and a floor element in an initial position.
Figure 8:
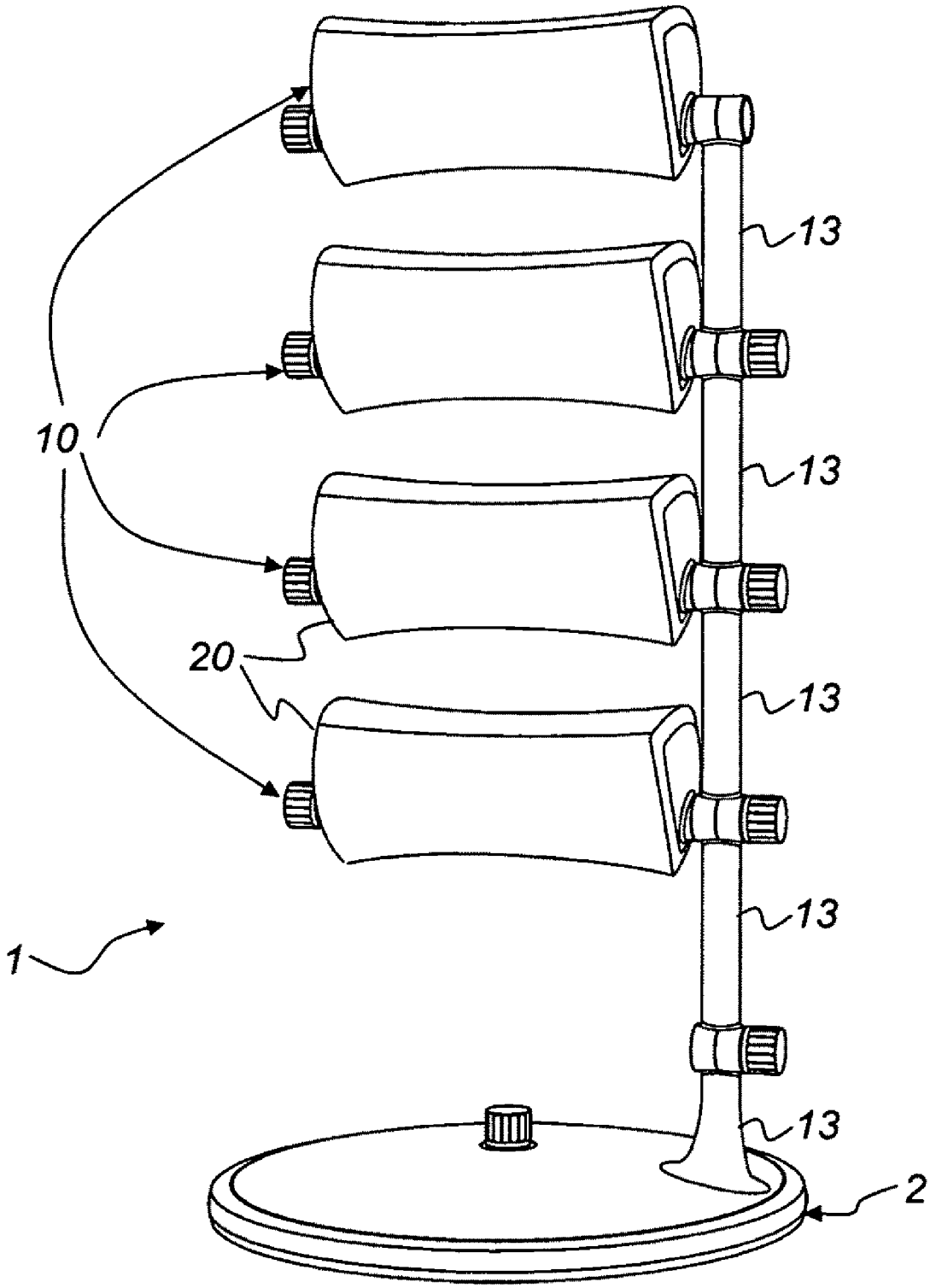
FIG. 8 shows a perspective view of the device for supporting a human body, wherein the device has four support elements and a floor element in an initial position.
Figure 9:
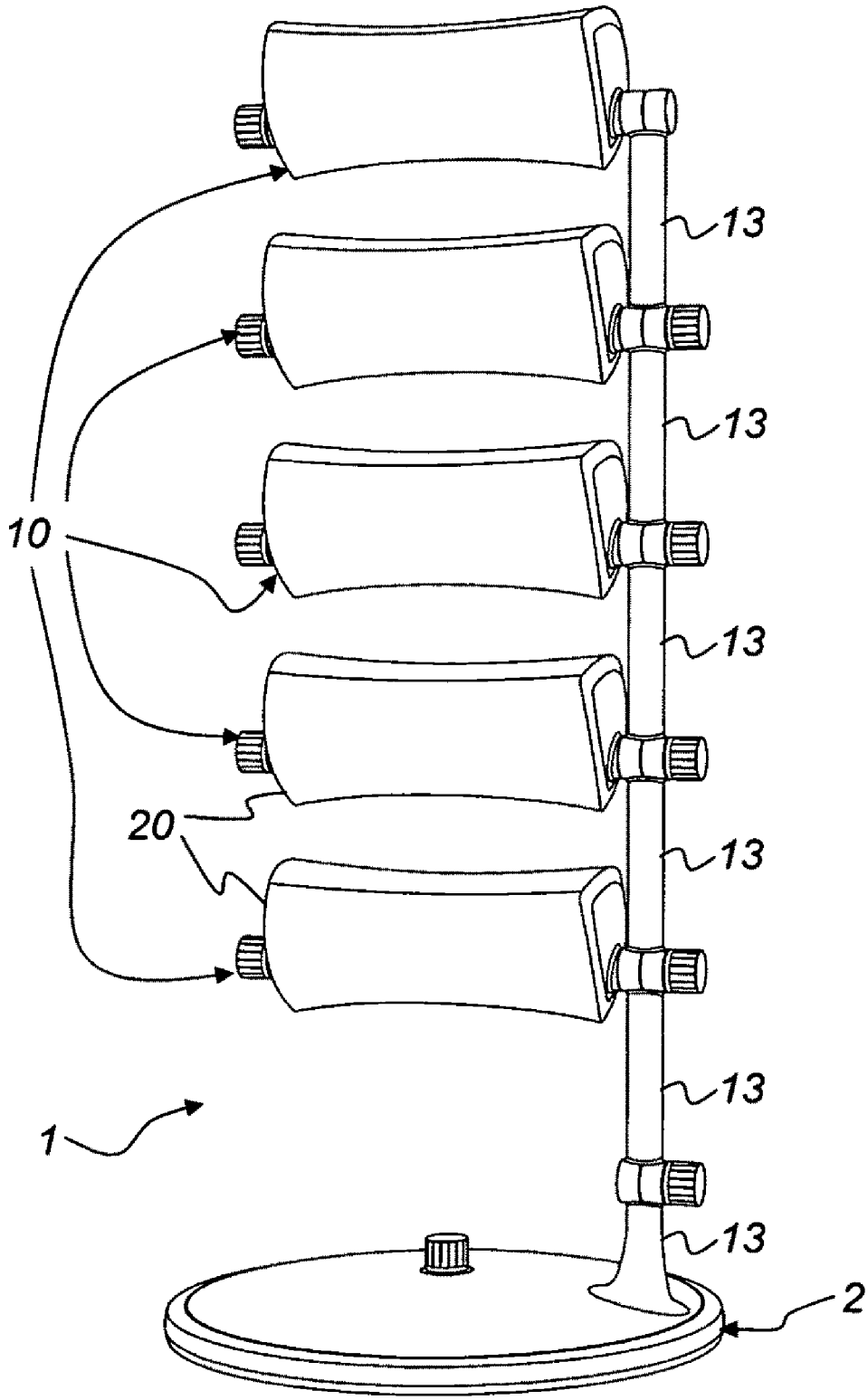
FIG. 9 shows a perspective view of the device for supporting a human body, wherein the device has five support elements and a floor element in an initial position.
Figure 10:
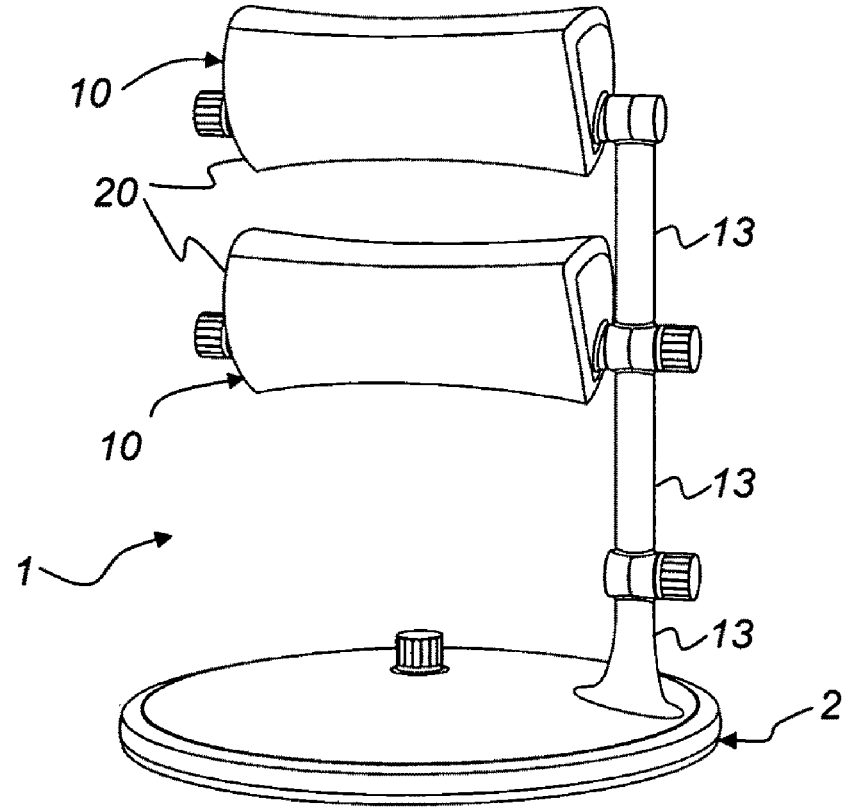
FIG. 10 shows a perspective view of the device for supporting a human body, wherein the device has two support elements and a floor element in an initial position.
Figure 11:
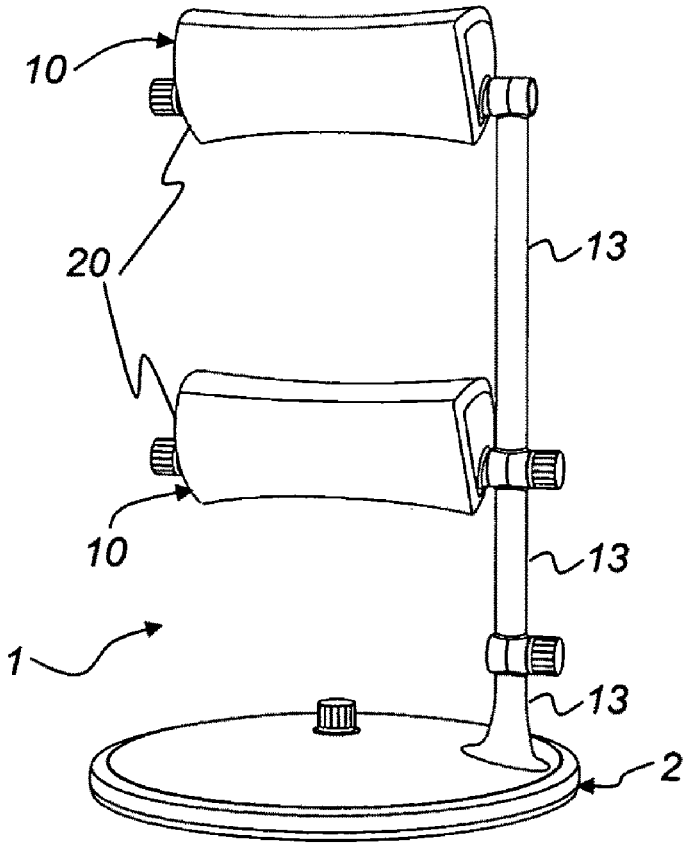
FIG. 11 shows a perspective view of a further embodiment of the device for supporting a human body, wherein the device has two support elements and a floor element in an initial position.
Figure 12:
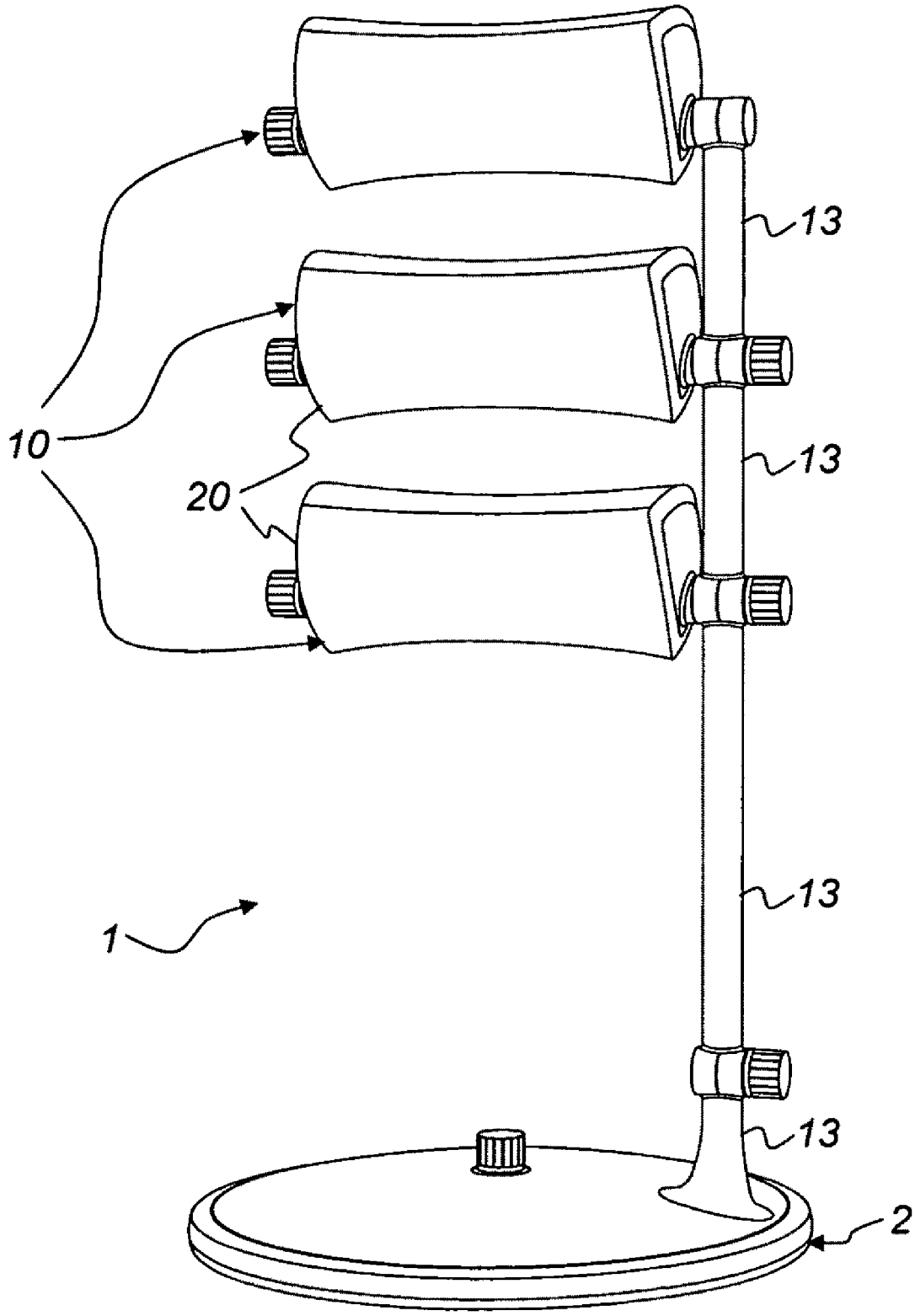
FIG. 12 shows a perspective view of a further embodiment of the device for supporting a human body, wherein the device has three support elements and a floor element in an initial position.
Figure 13:
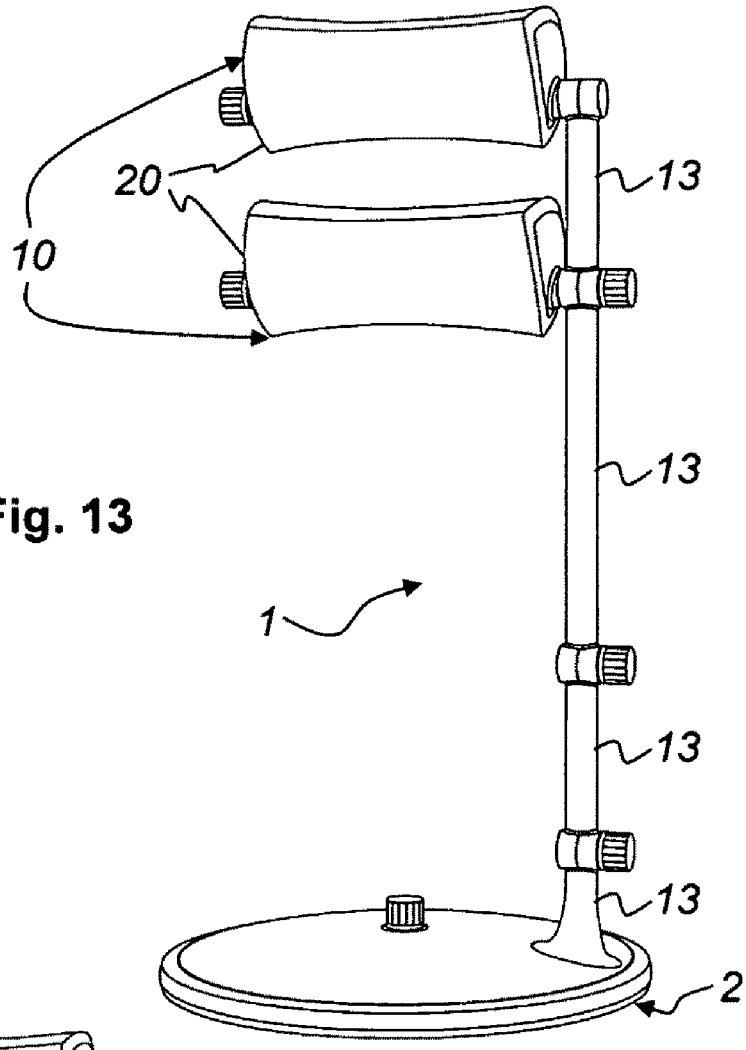
FIG. 13 shows a perspective view of a further embodiment of the device for supporting a human body, wherein the device has two support elements and a floor element in an initial position.
Figure 14:
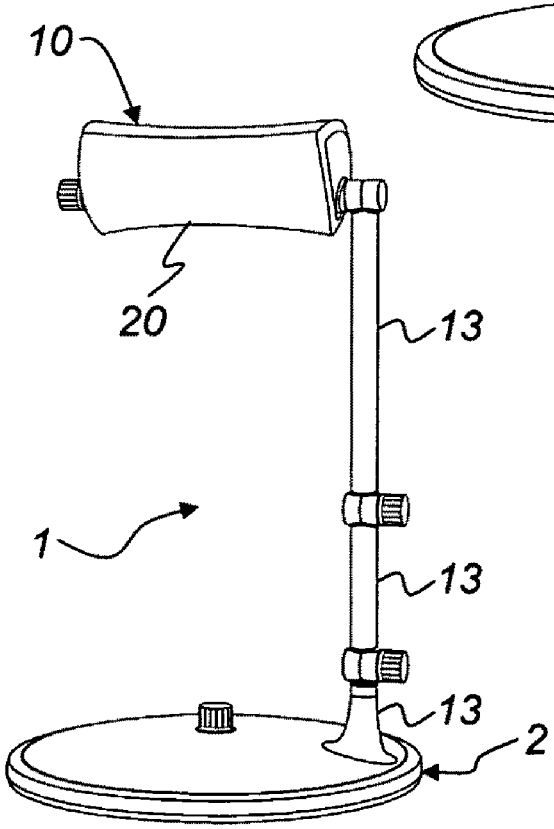
FIG. 14 shows a perspective view of a further embodiment of the device for supporting a human body, wherein the device has one support element and a floor element in an initial position.

FIG. 7 shows a perspective view of device 1 for supporting a human body, wherein device 1 has three support elements 10 and floor element 2 in initial position according to FIG. 1. Support bars 11 in this embodiment are positioned at an angle of 90 degrees with respect to longitudinal bars 13. Support elements 10, longitudinal bars 13 and floor element 2 can be positioned by means of positioning elements 16.

FIGS. 8 to 14 each show a perspective view of device 1 for supporting a human body, wherein device 1 has one to five support elements 10 and floor element 2 in the initial position. Some embodiments have longitudinal bars 13 all of equal length, and other embodiments have longitudinal bars 13 of different lengths. In the embodiments according to FIGS. 13 and 14 two longitudinal bars 13 are positioned successively without support element 10 branching off in between.

Figure 15:
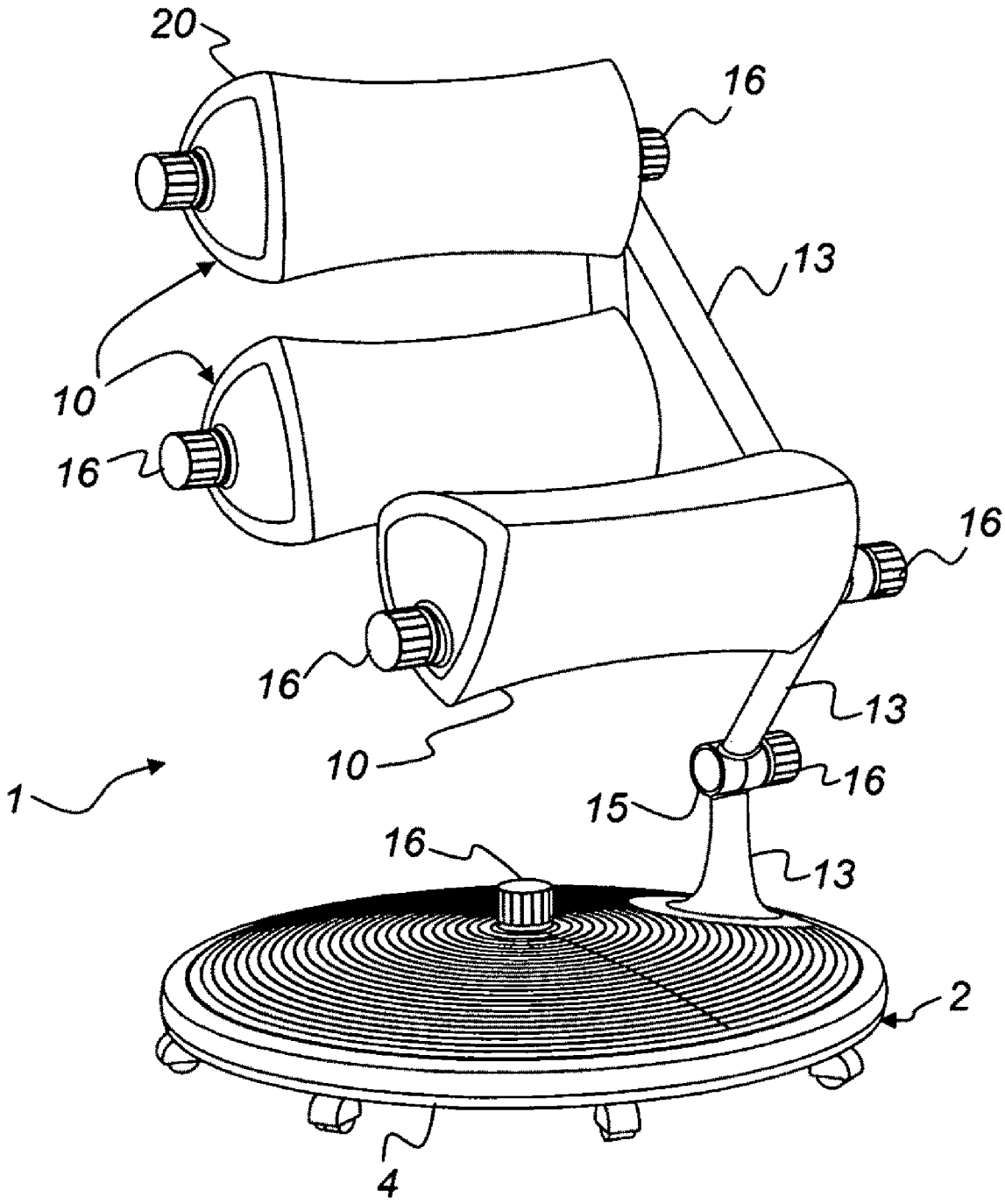
FIG. 15 shows a perspective view of an embodiment of the device for supporting a human body used as an office chair.

FIG. 15 shows a perspective view of an embodiment of device 1 for supporting a human body used as an office chair. A roller ring 4 is arranged underneath floor element 2 for floor guidance.

Figure 16:
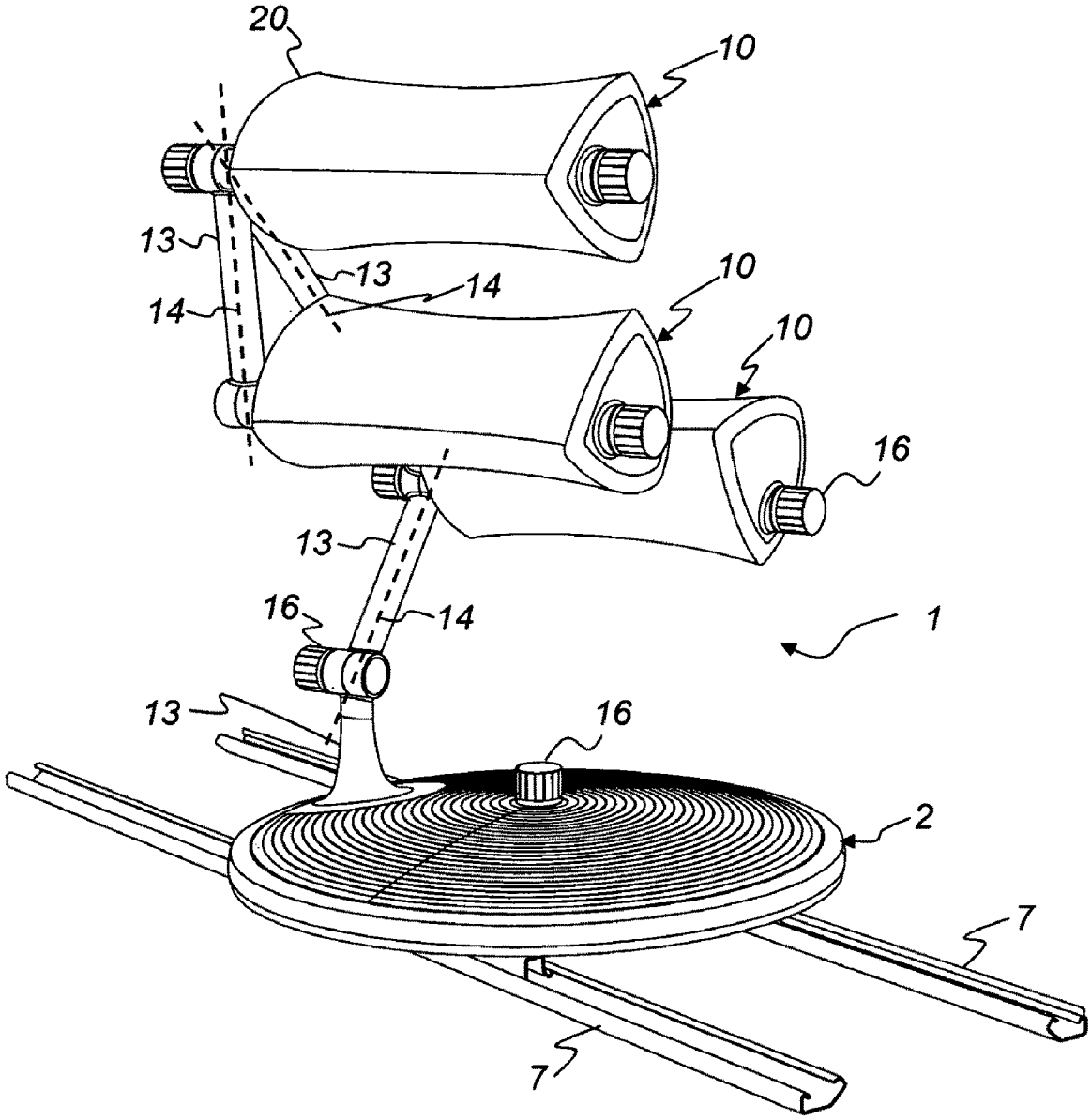
FIG. 16 shows a perspective view of an embodiment of the device for supporting a human body used in a guide rail system.

FIG. 16 shows a perspective view of device 1 for supporting a human body used in a guide rail system. Guide rails 7 for the translation of device 1 are indicated. A floor guidance element underneath floor element 2, for example wheels, runners, skids or blades, is not illustrated.

Figure 17:
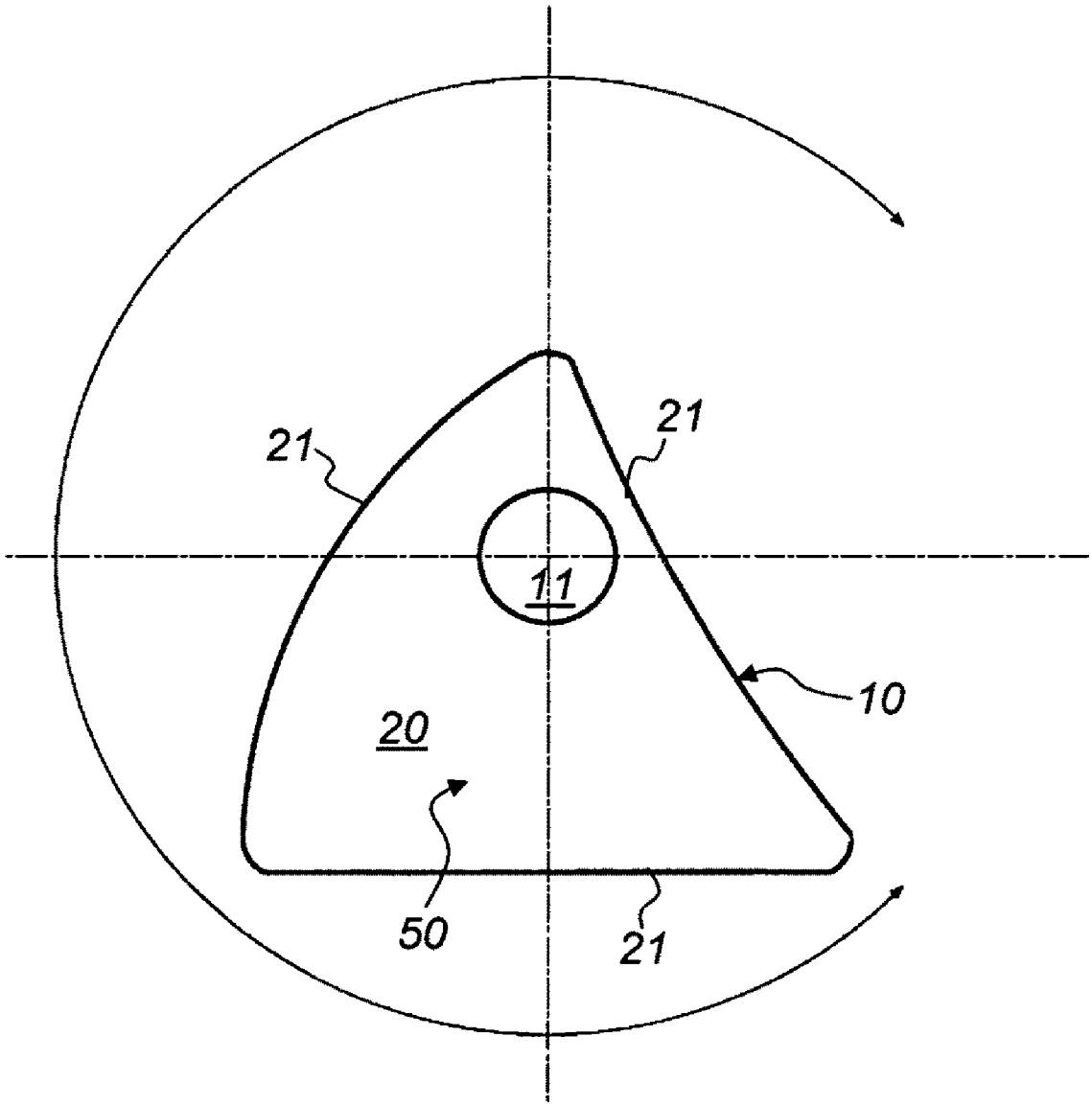
FIG. 17 shows a schematic cross-section of a support element.

FIG. 17 shows a schematic cross-section of support element 10. Support bar 11 is eccentrically arranged in cross-sectional area 50 of support element 10. Support element 10 is thus eccentrically rotatable around support bar 11, which is indicated by the circular arrow with two arrowheads. A cushion 20 is arranged around support bar 11. In contrast to the previous embodiments, cushion 20 comprises of three different lateral surface areas 21, namely a concave surface, a convex surface and a flat surface. Depending on the ergonomic and technical requirements, other morphologies of both cross-sectional area 50 and lateral surface areas 21 of support elements 10 are possible. Even though support elements 10 in the following descriptions always show the same morphology, this should not be understood as a limitation of the invention.

Figure 18:
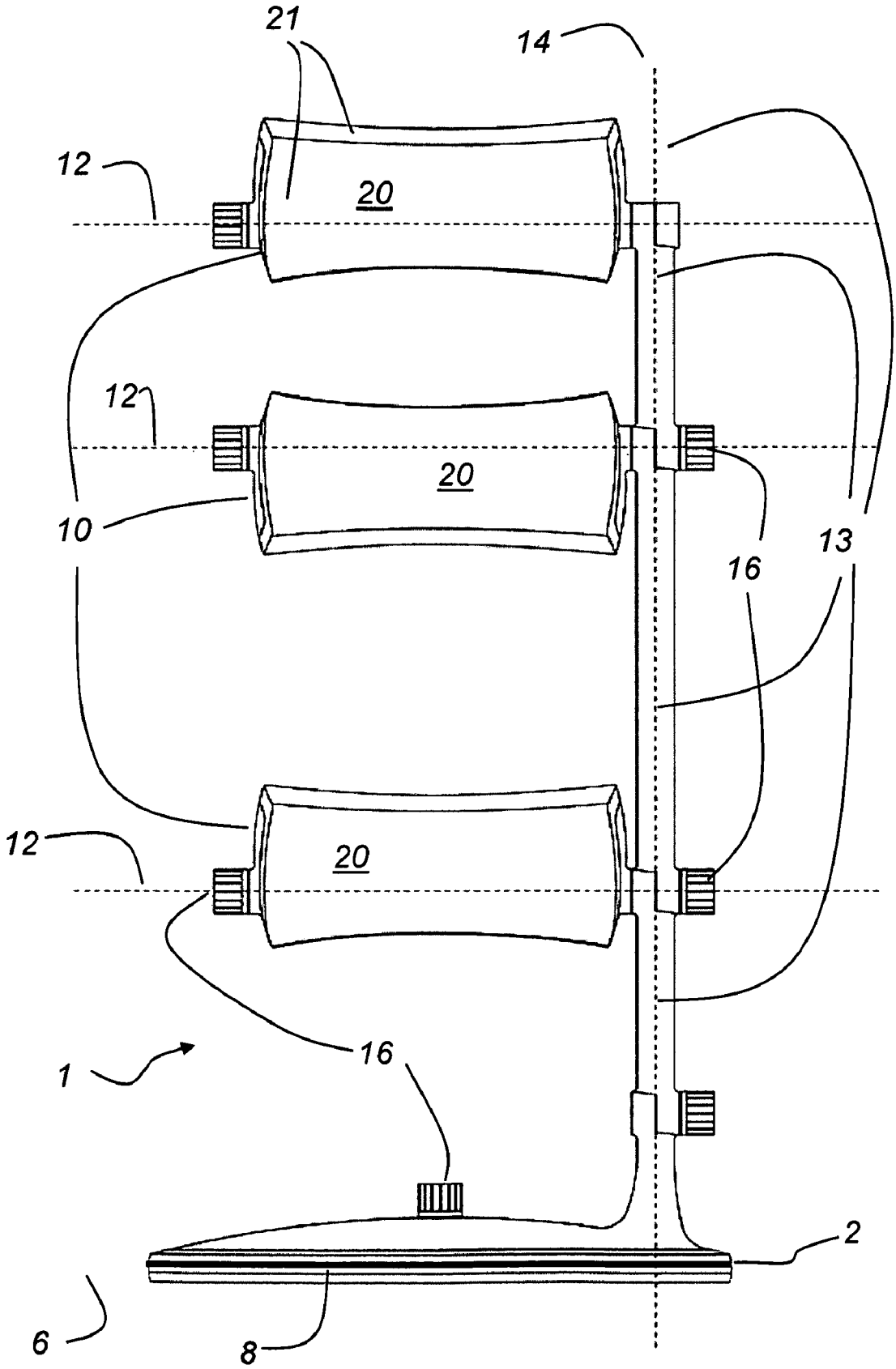
FIG. 18 shows a schematic view of an embodiment of the device for supporting a human body with three support elements and a floor element, the first axis of each support element and the second longitudinal axis of the longitudinal bars.

FIG. 18 shows a schematic view of device 1 for supporting a human body, wherein device 1 has three support elements 10 and floor element 2. The first longitudinal axes 12 defined by the respective support elements 10 and the second longitudinal axis 14 defined by longitudinal bars 13 are shown. Device 1 stands on floor 6 supported by means of floor element 2. An anti-slipping element 8 is indicated underneath floor element 2. Floor element 2 is reinforced at the connection with the lowest longitudinal bar 13. In this embodiment and in the initial position, longitudinal bars 13 and therefore their longitudinal axes 14 run decentralized with respect to floor element 2 and above floor element 2 in one line.

Positioning elements 16 are attached to the ends of support elements 10 opposite to longitudinal bars 13, to floor element 2 and to joints 15 of longitudinal bars 13 for their positioning.

First longitudinal axes 12 form the rotation axes of support elements 10 and run through support bars 11, which are hidden by cushions 20. In addition, first longitudinal axes 12 run through the eccentrically arranged support bars 11 in cross-sectional area 50 (see FIG. 17) of the respective support element 10, not central with regard to the length of the support elements 10. For the support of a plurality of body parts, different lateral surface areas 21 face the respective user's 30 body parts by means of different rotations of support elements 10 around their respective first longitudinal axis 12.

Figure 19:
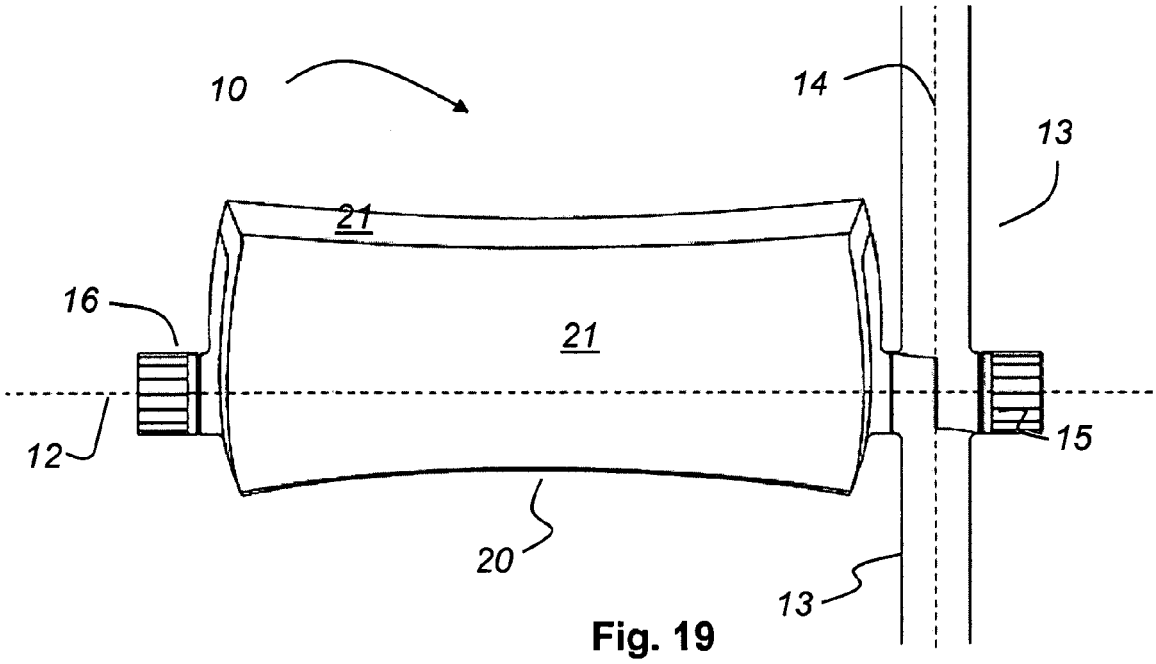
FIG. 19 shows a schematic detailed view of a support element with its first axis and the second longitudinal axis of the two longitudinal bars connected to the support element.

FIG. 19 shows a schematic detailed view of support element 10 according to FIG. 18 with first axis 12 of support bar 11 and second longitudinal axis 14 of longitudinal bar 13.

Figure 20:
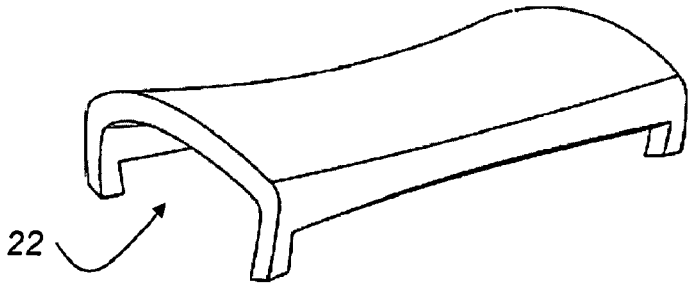
FIG. 20 shows a perspective view of a foot support.

FIG. 20 shows a perspective view of a foot support 22 which can be mounted preferably to each lateral surface area 21 of cushion 20 of support element 10 located opposite to the floor on which device 1 stands.

Figure 21:
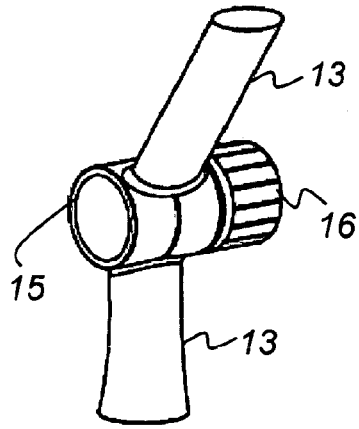
FIG. 21 shows a perspective view of a joint with a positioning element.

FIG. 21 shows a perspective view of joint 15 with positioning element 16. Here, joint 15 is positioned between two successive longitudinal bars 13.

Figure 22:
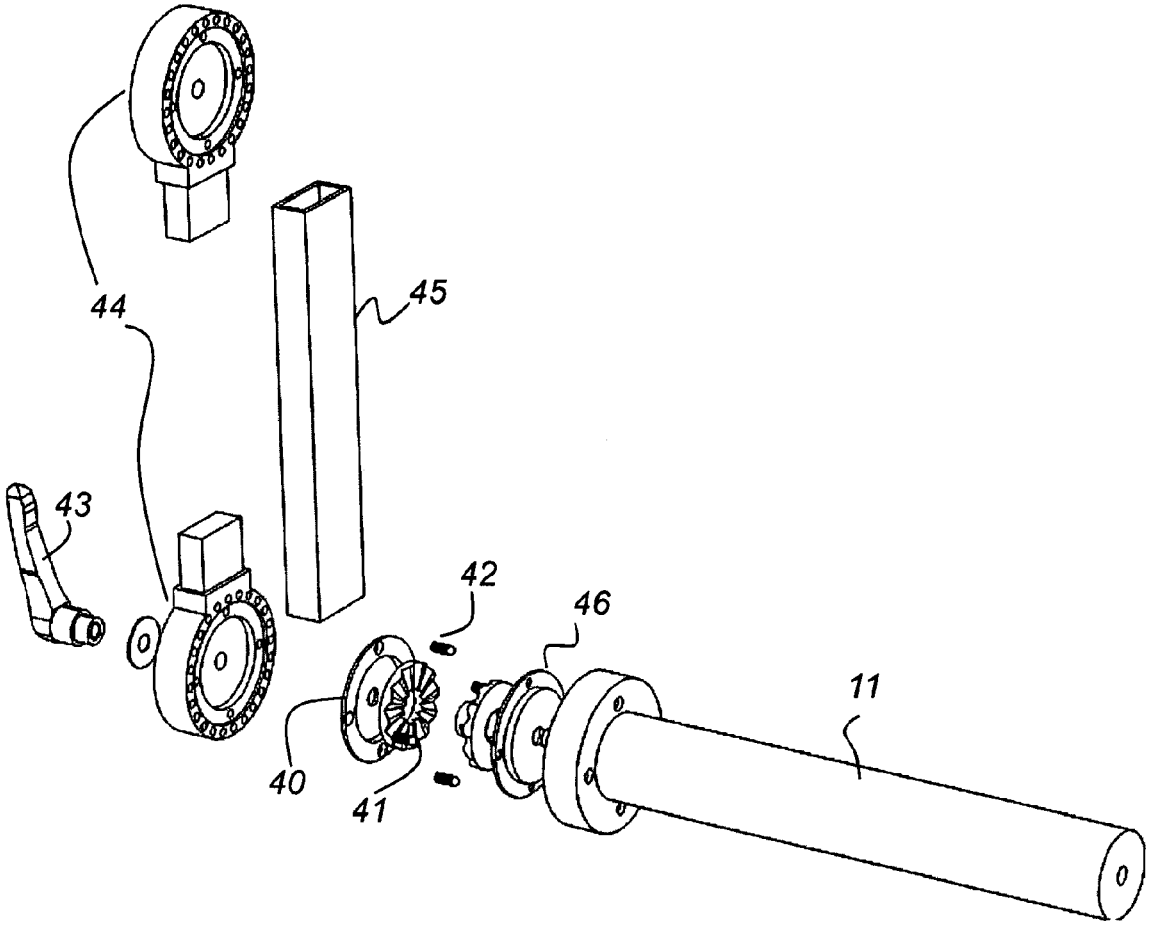
FIG. 22 shows an exploded view of a support bar and the parts of its joint.

FIG. 22 shows an exploded view of support bar 11 and the parts of its joint 15 according to the prior art, such as a release handle 43, two flange-milling elements 44, a square profile 45 (other morphologies are also possible without limiting the invention), a steel inlay 40 with a spur gear 41, screws 42 and a steel inlay 46 with a spur gear and a housing-milling element which connects to support bar 11. The assembled parts form joint 15 which provide several steps for the positioning of angles. The steps are defined by the design of spur gear 41 and the corresponding disc.

Figure 23:
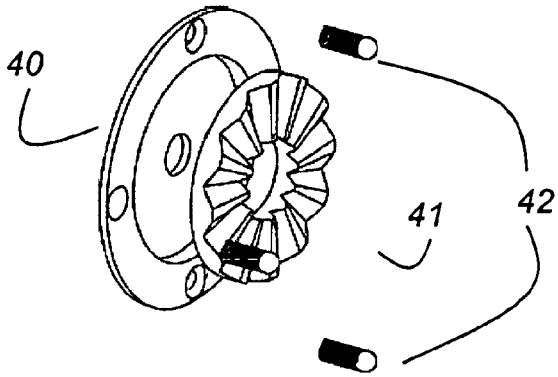
FIG. 23 shows a schematic detailed view of a steel inlay and a spur gear.

FIG. 23 shows a detailed view of a commercially available steel inlay 40 and spur gear 41 according to prior art, as well as fitting screws 42.

Figure 24:
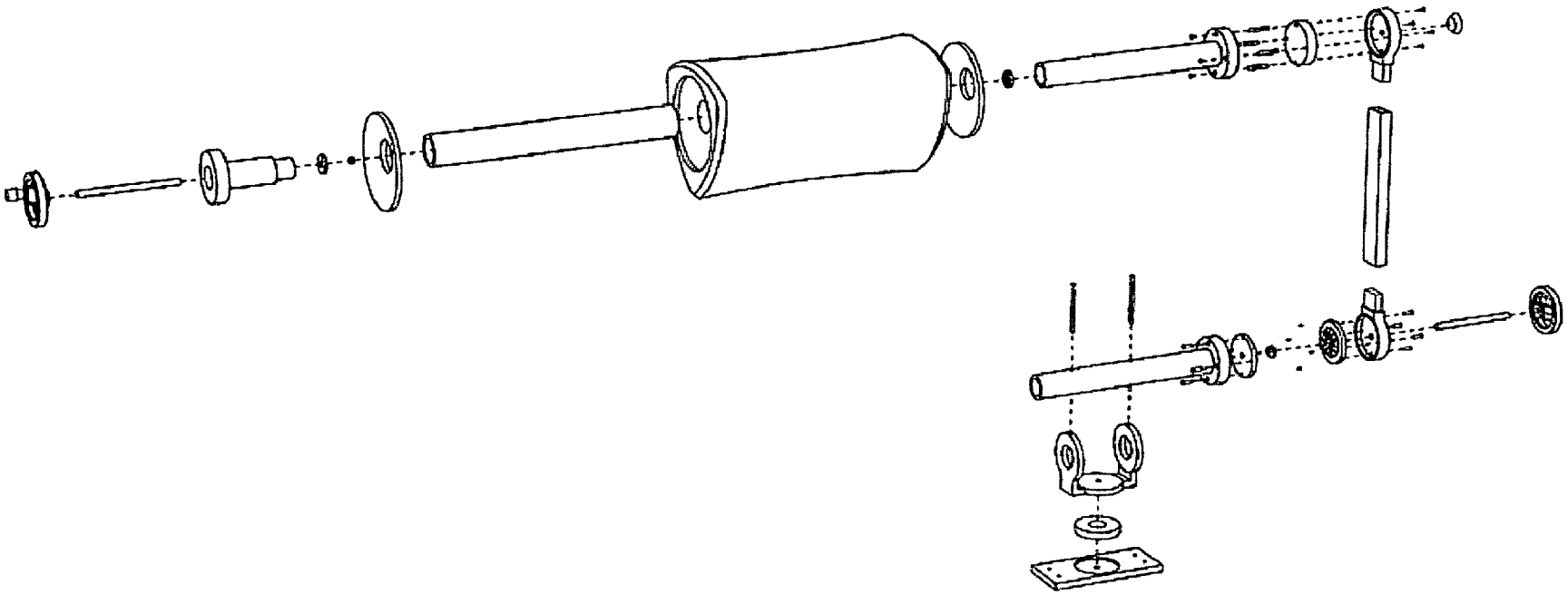
FIG. 24 shows an exploded view of a support element, a support bar and the parts of its joint.

FIG. 24 shows an exploded view of support element 10, components of its support bar 11 and components of its joint 15 according to prior art.

Figure 25:
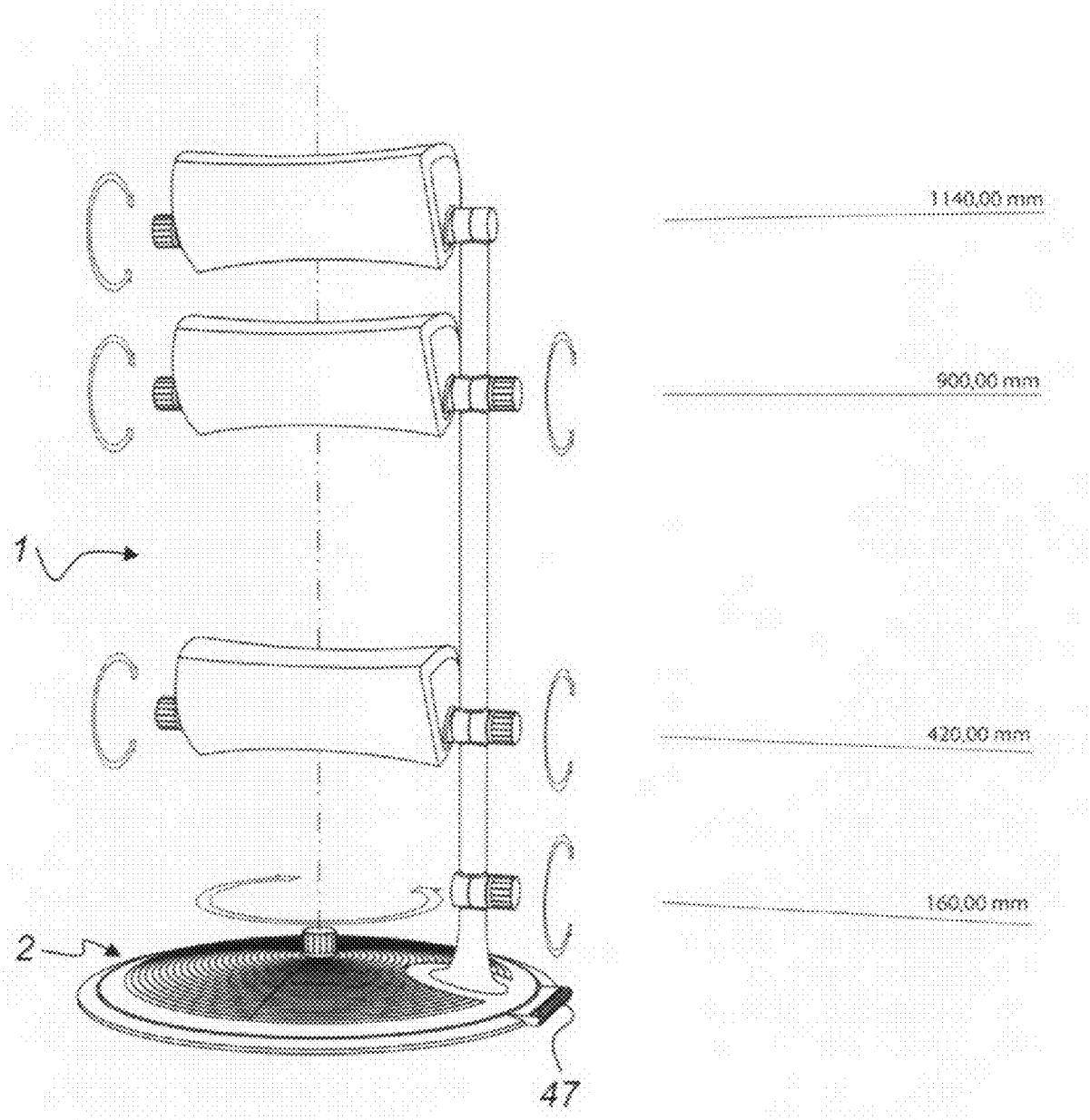
FIG. 25 shows a perspective view of the device for supporting a human body providing measurements specifications; and, FIG. 26 shows a schematic view of the device for supporting a human body in connected to a mechanical/electronic positioning module.

FIG. 25 shows a perspective view of device 1 for supporting a human body with typical measurement specifications. In this embodiment, the length of longitudinal bars 13 from top to bottom end are 1140.00 mm, 900.00 mm and 420.00 mm respectively. The distance between floor element 2 and the respective joint 15 measures 180.00 mm. An additional roller element 47 is attached to floor element 2, which functions as an ergonomically optimal positioning device of the entire device 1 for supporting a human body.

Figure 26:
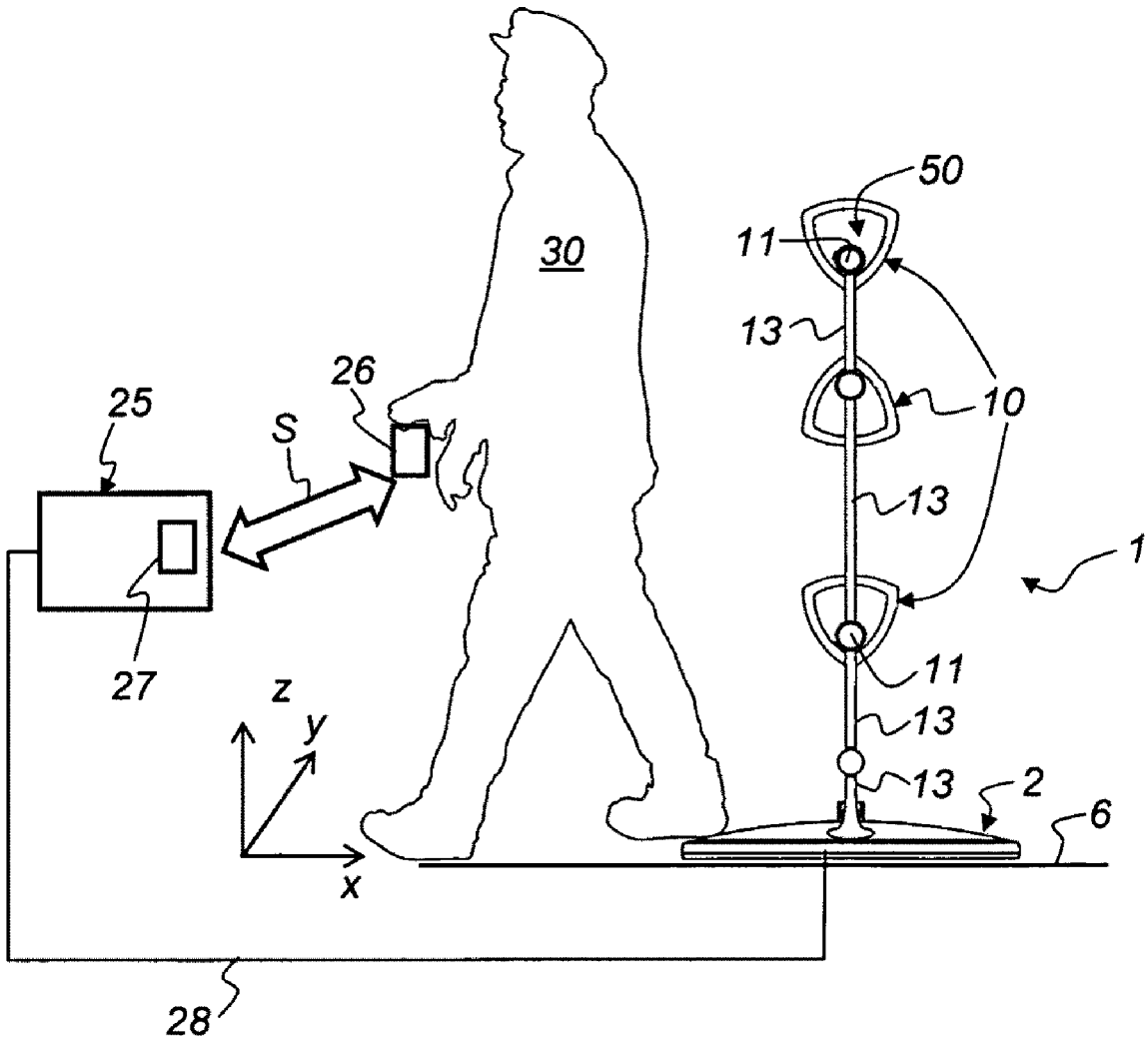

FIG. 26 shows a schematic view of device 1 for supporting a human body, which is connected to a mechanical/electronic positioning module 25 via a connection 28; for example via a radio communication or a cable connection. A chip 26 with user-specific data is read by a transponder 27 of mechanical/electronic positioning module 25 through a signal S of chip 26 which is sent to transponder 27. The user-specific data for example may comprise of date of birth, sex, body weight, body proportions, and working position of each user 30.

The user data typically varies for different users 30. Reading the stored user data, mechanical/electronic positioning module 25 calculates then the required positioning for the respective device 1 while considering the requested use of the respective device 1. Finally, mechanical/electronic positioning module 25 sends the data for positioning the respective device 1 via connection 28 to the respective device 1 according to which motor positioning follows automatically.

Finally, it should be noted, in particular, that the previously described exemplary embodiments, only serve to describe the teachings claimed, and are not limiting to the exemplary embodiments. It is conceivable however, that variations and modifications of the invention can be made without departing from the scope of protection of the appended claims.

What is claimed is:

1. A device (1) for supporting a human body comprising:

at least one support element (10) defining a cross-sectional area (50) and wherein the at least one support element (10) is positionable in height and depth;

at least one longitudinal bar (13); and, at least one support bar (11), wherein the at least one support element (10) is connected to the at least one longitudinal bar (13) via the at least one support bar (11), and wherein the at least one support bar (11) extends at least partly along a first longitudinal axis (12) of the at least one support element (10) and through the at least one support element (10), wherein the at least one support bar (11) is eccentrically arranged in the cross-sectional area (50) of the at least one support element (10).

2. The device (1) for supporting a human body recited in claim 1 further comprising a cushion (20), wherein the cushion is secured to the at least one support element (10), and wherein the cushion has at least a first lateral surface area and a second lateral surface area.

3. The device (1) for supporting a human body recited in claim 2 wherein a first shape of the first lateral surface area (21) is different than a second shape of the second lateral surface area.

4. The device (1) for supporting a human body recited in claim 2 wherein the at least one support element (10) comprises a lowest support element which is located opposite to a floor on which the device (1) stands, wherein the cushion is secured to the lowest support element; and, wherein the device (1) further comprises a foot support (22) which is removable and attachable to the first lateral surface area (21) of the cushion (20).

5. The device (1) for supporting a human body recited in claim 1 further comprising a floor element (2).

6. The device (1) for supporting a human body recited in claim 1 wherein the at least one support element (10) is positionable in height and depth by altering a position of the at least one longitudinal bar (13).

7. The device (1) for supporting a human body recited in claim 6 wherein the at least one support element (10) comprises a plurality of support elements, and each support element is positionable in height and depth independently of each other support element (10) in the plurality of support elements.

8. The device (1) for supporting a human body recited in claim 1, comprising at least two successive longitudinal bars (13), wherein an angle between said at least two successive longitudinal bars (13) is adjustable by a joint (15), whereby the joint (15) connects the two successive longitudinal bars (13).

9. The device (1) for supporting a human body recited in claim 8 wherein the device (1) further comprises:

a floor element; and, a plurality of positioning elements (16) which are mounted on the joint (15), the at least one support element (10), the floor element (2), or combinations thereof, whereby the angle between the at least two successive longitudinal bars (13), a second angle between a lowest of the at least two successive longitudinal bars (13) and the floor element (2), an eccentric rotation of the at least one support element with respect to the first longitudinal axis of the at least one support bar (10), a rotation of the floor element (2) with respect to the floor, or combinations thereof, are positioned by the positioning elements (16), wherein the eccentric rotation of the at least one support element is enabled by the at least one support bar extending through and being eccentrically arranged in the cross-sectional area of the at least one support element.

10. The device (1) for supporting a human body recited in claim 9, wherein a positioning of the positioning elements (16) is carried out manually.

11. The device (1) for supporting a human body recited in claim 1 wherein the at least one support element (10) is rotatable around a second longitudinal axis (14) defined by the at least one longitudinal bar (13) to which the at least one support element (10) is connected.

12. The device (1) for supporting a human body recited in claim 1 wherein the at least one longitudinal bar (13) comprises a plurality of longitudinal bars, and wherein at least one of the longitudinal bars in the plurality of longitudinal bars is of a different length than each other longitudinal bar in the plurality of longitudinal bars.

13. The device (1) for supporting a human body recited in claim 1 comprising a mechatronic positioning module (25) with which body proportions and a weight of a user (30) are determined and stored by means of Radio Frequency Identification technology, an actual position of the device (1) is sensed and actuators are used to place the device (1) into a requested position, whereby the at least one support element (10), the at least one longitudinal bar (13) and a floor element (2) of the device are individually positioned by the mechatronic positioning module (25).

14. The device (1) for supporting a human body recited in claim 13, wherein the mechatronic positioning module (25) comprises a transponder (27), which reads and stores the body proportions and the weight of the user (30) as well as individual and desired positions of the at least one support element (10) of the device (1) with an electronic chip (26).

15. A working system (35) in a production line comprising the device (1) for supporting a human body recited in claim 1.

16. A device for supporting a human body comprising:

a plurality of support elements each defining a cross-sectional area and a longitudinal axis, wherein at least one of the support elements is positionable in height and depth;

at least one longitudinal bar; and, a plurality of support bars corresponding to the support elements, wherein one support bar is provided for each of the support elements, wherein each support element is connected to the at least one longitudinal bar via a corresponding one of the support bars, and each support element extends at least partly along the longitudinal axis of the corresponding one of the support elements, wherein each support bar is eccentrically arranged in the cross-sectional area of the corresponding one of the support elements.

17. The device recited in claim 16 wherein the at least one longitudinal bar comprises a plurality of longitudinal bars and each support bar is connected to at least one of the longitudinal bars.

* * * * *